United States Patent [19]

Heil, Jr. et al.

[11] Patent Number: 4,805,437

[45] Date of Patent: Feb. 21, 1989

[54] METHOD AND APPARATUS FOR PRODUCING FASTENERS HAVING WRENCHING SOCKETS THEREIN

[75] Inventors: Nicholas A. Heil, Jr.; Robert J. Schilling, both of Tiffin, Ohio

[73] Assignee: The National Machinery Company, Tiffin, Ohio

[21] Appl. No.: 135,610

[22] Filed: Dec. 21, 1987

[51] Int. Cl.[4] ..... B21D 37/08; B21K 1/44

[52] U.S. Cl. ..... 72/356; 72/359; 10/27 E; 10/27 H; 10/27 PH

[58] Field of Search ..... 72/352, 353, 356, 358, 72/359; 10/27 E, 27 H, 27 PH, 27 R

[56] References Cited

U.S. PATENT DOCUMENTS

| | | | |
|---|---|---|---|
| 960,244 | 6/1910 | Allen | 10/27 E |
| 1,051,088 | 1/1913 | Clark | 10/27 PH |
| 1,642,696 | 9/1927 | Rateike | 72/267 |
| 1,963,942 | 6/1934 | Flynn | 10/27 PH |
| 2,133,467 | 10/1939 | Purtell | 10/27 PH |
| 2,236,733 | 4/1941 | Purtell | 10/27 PH |
| 3,626,531 | 12/1971 | Mazer et al. | 10/27 E |
| 4,166,373 | 9/1979. | Braun | 10/27 E |

FOREIGN PATENT DOCUMENTS

| | | | |
|---|---|---|---|
| 405657 | 11/1924 | Fed. Rep. of Germany | 10/27 H |
| 92032 | 5/1985 | Japan | 72/256 |

OTHER PUBLICATIONS

Fasteners, vol. 9, No. 2; p. 9, "Hot Forging".

*Primary Examiner*—Lowell A. Larson

*Attorney, Agent, or Firm*—Pearne, Gordon, McCoy & Granger

[57] ABSTRACT

A method and apparatus are disclosed for forging a wrenching socket in the end of a fastener which permit the production of such fasteners from materials which are difficult to forge, such as titanium and some high strength steels. A cylindrical preliminary socket is formed in the end of the blank forming the fastener with a punch having a circular cross section. The preliminary socket is sized to be at least as great as the maximum lateral dimension of the finished wrenching socket required. Subsequently, a tool having a cross-sectional shape corresponding to the required finished socket is positioned in the preliminary socket and the material of the blank is extruded inwardly against the tool to form a cylindrical exterior surface and a finished socket having a non-circular cross section. With this invention, even very small hexagonal sockets can be formed in titanium fasteners. The particular illustrated embodiment also utilizes warm-forming, in which the blank material is heated to a temperature in the range of 1200° to 1400° F. before being formed.

17 Claims, 3 Drawing Sheets

METHOD AND APPARATUS FOR PRODUCING FASTENERS HAVING WRENCHING SOCKETS THEREIN

BACKGROUND OF THE INVENTION

This invention relates generally to the manufacture of fasteners, and more particularly to a novel and improved method and apparatus for producing fasteners having wrenching sockets, such as hexagonal sockets formed therein.

PRIOR ART

Socket head screws having non-circular wrenching openings therein are well known. In many instances, the opening or socket is formed with a hexagonal cross section sized to accept an Allen wrench or the like. Generally in the past, fasteners of such type were produced by pressing a hexagonal punch into the fastener blank, causing the material of the blank to flow and extrude back around the punch to produce the desired shape of wrenching socket. U.S. Pat. No. 1,978,371 discloses a typical example of such method of producing socket head cap screws.

It is also known to form socket head fasteners by upsetting the fastener blank material within a die, using a punch which forms a cylindrical opening in the head, and thereafter, in the same die, further upsetting the material of the head with a hexagonal punch to produce a hexagonal socket within the head of the fastener. Such process is illustrated and described in U.S. Pat. No. 3,182,342.

U.S. Pat. No. 3,457,573 also discloses a method of producing a hollow bolt having a hexagonal wrenching socket extending from one end thereof. In accordance with the method of such patent, a hexagonal mandrel is positioned within a tube and the material of the tube is deformed radially in against the surface of the mandrel and extruded along the length thereof to produce a bolt portion which provides a hexagonal inner surface for wrenching purposes and a cylindrical exterior surface.

The method of producing socket head cap screws illustrated in U.S. Pat. No. 1,978,371, supra, in which a hexagonal punch is driven into the material of the fastener to form a wrenching socket therein, has been extensively used. However, difficulties are encountered due to punch breakage or excessive wear if the material forming the fastener is difficult to forge. Further, the difficulty is accentuated when the socket must be quite small. For example, it has been virtually impossible to forge small wrenching sockets in titanium and in some highstrength steels on a production basis utilizing a noncircular punch to form the wrenching socket within the fastener.

SUMMARY OF THE INVENTION

The present invention provides a novel and improved method and apparatus for forming fasteners with wrenching sockets. With the present invention, very small wrenching sockets can be produced in materials which are difficult to form, such as titanium and high-strength steel, without encountering excessive tool wear or tool breakage.

In accordance with this invention, a preliminary socket having a circular cross section is formed in the material of the blank used to form the fastener. Subsequently, a finish tool having the shape of a required wrenching socket is positioned in the preliminary socket and the material around the preliminary socket is deformed inwardly into mating engagement with the tool. Because the tool is not subjected to high forces required to flow the material and produce the socket, wear and tool breakage are minimized.

Further, because the punch which forms the initial socket does not have sharp edges, which tend to wear, the punch provides a good tool life.

In the preferred embodiment, the circular punch which forms the preliminary socket has a diameter equal to ore greater than the maximum lateral dimensions of the required finished socket. Therefore, the finish tool can be easily positioned within the preliminary socket without deforming the material of the blank. Consequently, the finish tool is not subjected to high forming loads.

Further, it is preferred to form the size of the preliminary socket so that the cross-sectional area of the blank material around the preliminary socket is slightly greater than the cross-sectional area of the material around the finished socket. Therefore, when the material is deformed inwardly against the finish tool, some lengthwise displacement must occur, ensuring that the material of the blank around the socket accurately takes the shape of the finish tool.

In the preferred and illustrated embodiment, the blank having the preliminary socket therein is axially pressed through an extrusion die which deforms the material of the blank inwardly into engagement with the finish tool.

In instances in which the fastener is manufactured from titanium, which is a material very difficult to deform by forging processes, the blank material is first heated and is formed by what is normally referred to as "warm forming". For example, the blank material is preferably at a temperature of about 1200° F. to 1400° F. when it is processed in accordance with the method of this invention.

With this invention, it is practical to forge articles which have been impractical to forge in the past.

These and other aspects of this invention are illustrated in the accompanying drawings, and are more fully described in following specification.

DETAILED DESCRIPTION OF THE DRAWINGS

The fastener which is produced in the illustrated embodiment of this invention is a fastener known in industry as a "HI-LOK fastener." Such fasteners are used extensively in the aircraft industry and are illustrated in U.S. Pat. Nos. 3,138,987 and 3,390,906. Such patents are incorporated by reference.

Prior to the present invention, it has been virtually impossible to produce such a fastener by forging processes when the material of the fastener was titanium.

Figure 4:
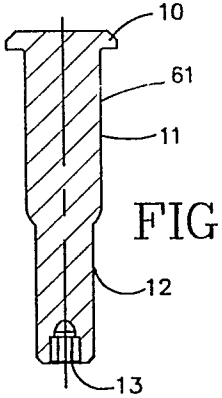
FIG. 4 illustrates the finished blank after the wrenching socket is completed.

The finished blank illustrated in FIG. 4 provides a head 10, a shank 11 of the first diameter, and a reduced diameter extension 12 extending from the end of the shank 11 remote from the head 10. A hexagonal socket 13 is formed in the end of the extension 12 and is sized to receive a hexagonal wrench. The finished blank of FIG. 4 is subsequently roll-threaded along the reduced diameter portion 12.

Figure 1:
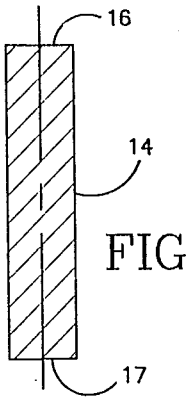
FIG. 1 illustrates the shape of an initial blank.

FIG. 1 illustrates the initial blank used to form the fastener illustrated in FIG. 4 in accordance with the present invention. The initial blank 14 has a cylindrical shape and relatively square and flat ends 16 and 17. Such blank 14 is normally sheared from wire or rod stock, as illustrated in FIG. 5.

The tooling of the present invention is mounted on a transfer former or forging machine of the general type illustrated and described in U.S. Pat. No. 3,247,534, and such patent is incorporated herein by reference to illustrate the overall structure of such machines.

Figure 5:
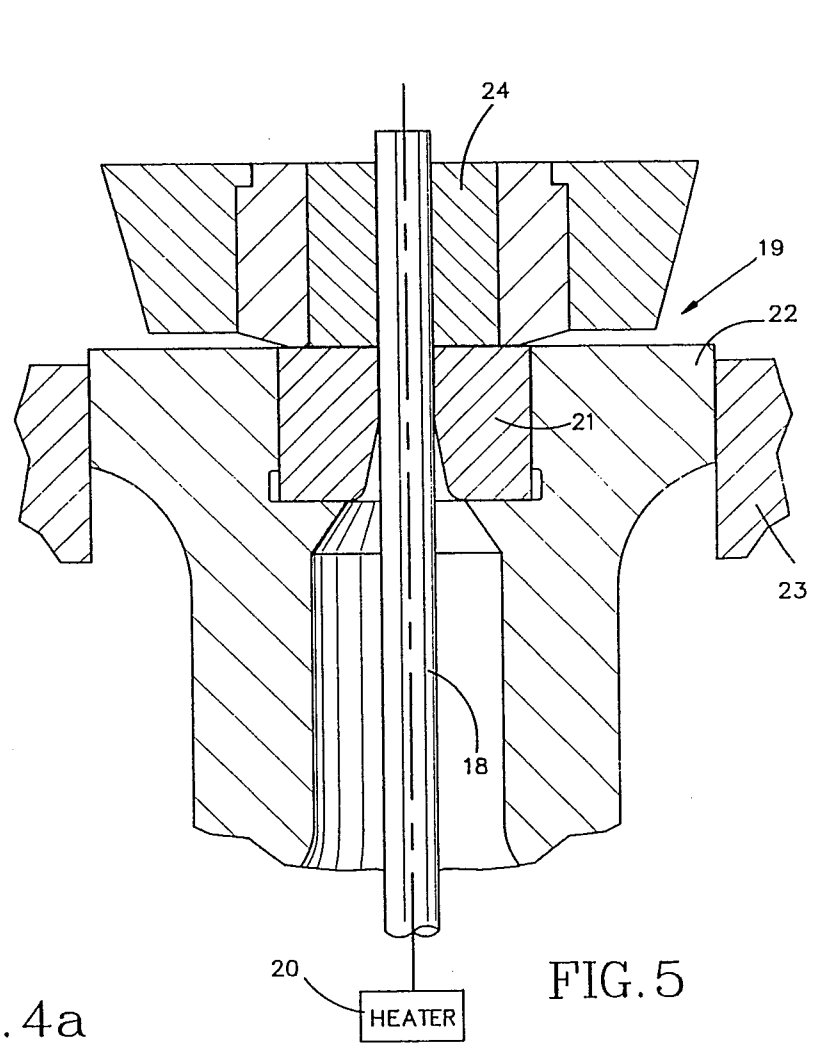
FIG. 5 is a longitudinal section of the shearing station in which the blanks of FIG. 1 are cut from rod or wire stock.
Figure 2:
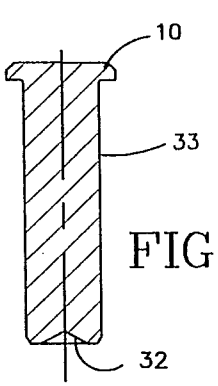
FIG. 2 illustrates the first intermediate blank after the first forming operation thereon.
Figure 6:
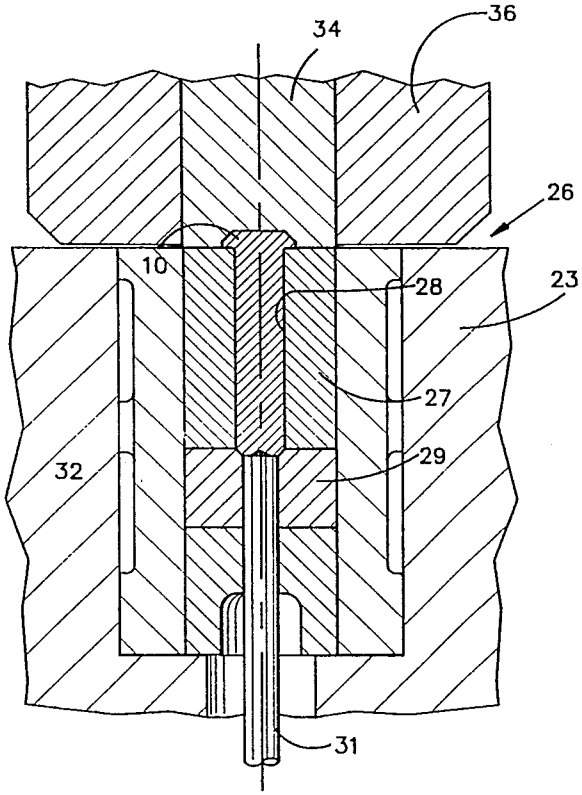
FIG. 6 is a longitudinal section illustrating the tooling at a first work station in which a head is formed to produce the first intermediate blank of FIG. 2.

As illustrated in FIG. 5, rod stock 18 is longitudinally fed into a shear station 19 of a progressive former through a heater schematically illustrated at 20. At the shear station, a cutting die 21 is mounted within tooling 22, which is in turn supported on the frame 23 of the progressive former. The stock 18 projects through a cutter tube 24, which is movable along the face of the cutting die 21 and operates to shear the blank 14 from the stock. Subsequently, the blank is ejected into an automatic transfer (not illustrated) which transports the blank 14 to a first work station 26, illustrated in FIG. 6. At the first work station, a die set is mounted in the machine frame and provides a forward die 27 having a uniform diameter die cavity 28 formed therein. Rearwardly of the forward die 27 is a backup die 29 and a kickout pin 31. The end face of the kickout pin is shaped to form a shallow, conical recess 32 (best illustrated in FIG. 2) in the end of the first intermediate blank 33.

An upsetting tool 34 is carried by the slide assembly 36 of the forming machine. The slide is reciprocable back and forth between a forward position and a retracted position in the usual manner. As the slide carries the tool to its forward position illustrated in FIG. 6, the tool 34 upsets a head 10 on the end of the blank 14 projecting out of the die 27 and the shallow recess 32 is formed at the inner end of the blank.

Figure 7:
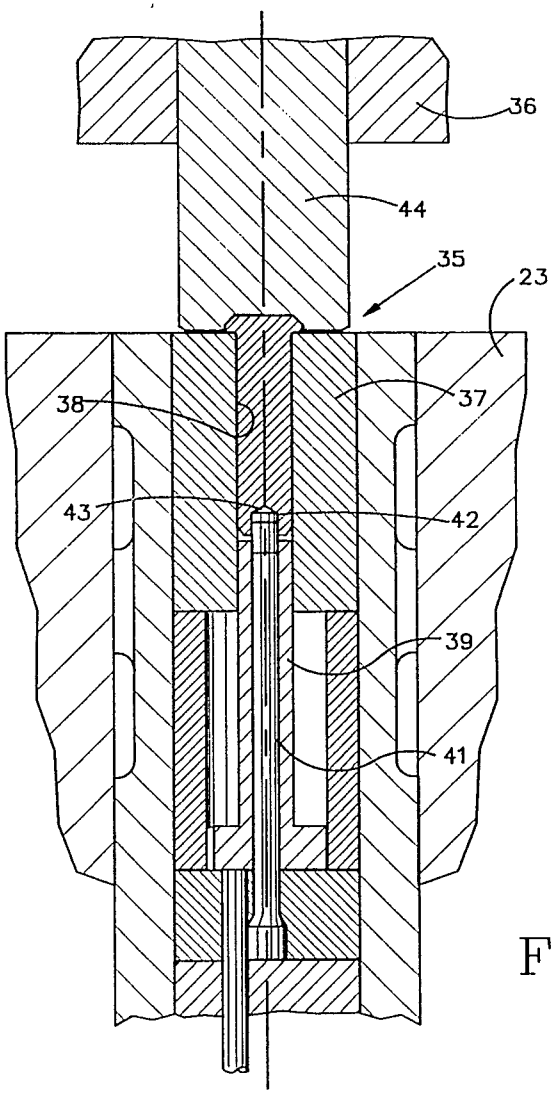
FIG. 7 is a longitudinal section illustrating the tooling at a second work station in which a preliminary socket in the end of the blank produces the second intermediate blank of FIG. 3.

After the first intermediate blank 33 is formed at the work station 26, the blank 33 is ejected by the kickout pin into a transfer which transfers the intermediate blank to a second work station 35 illustrated in FIG. 7. At this work station, a tubular die 37 having a cylindrical die cavity 38 is again mounted in the machine frame 23. Projecting into the die cavity 38 is a stripper sleeve 39 through which a preliminary punch 41 projects. The forward end of the punch is provided with a cylindrical land 42 and a shallow conical end face 43.

Figure 3:
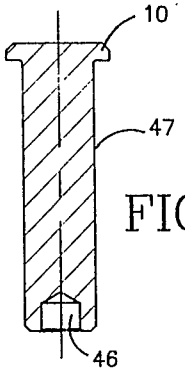
FIG. 3 illustrates the second intermediate blank after the preliminary socket is formed in the end thereof.

Also located at the second work station 35 is a tool 44 carried by the slide assembly 36 which presses the first intermediate blank 33 down along the die 37 and over the end of the preliminary punch 41 to form a preliminary socket 46 in the end of a socket intermediate blank 47, as best illustrated in FIG. 3. In such operation, the head 10 formed in the previous work station remains unchanged.

Figure 9:
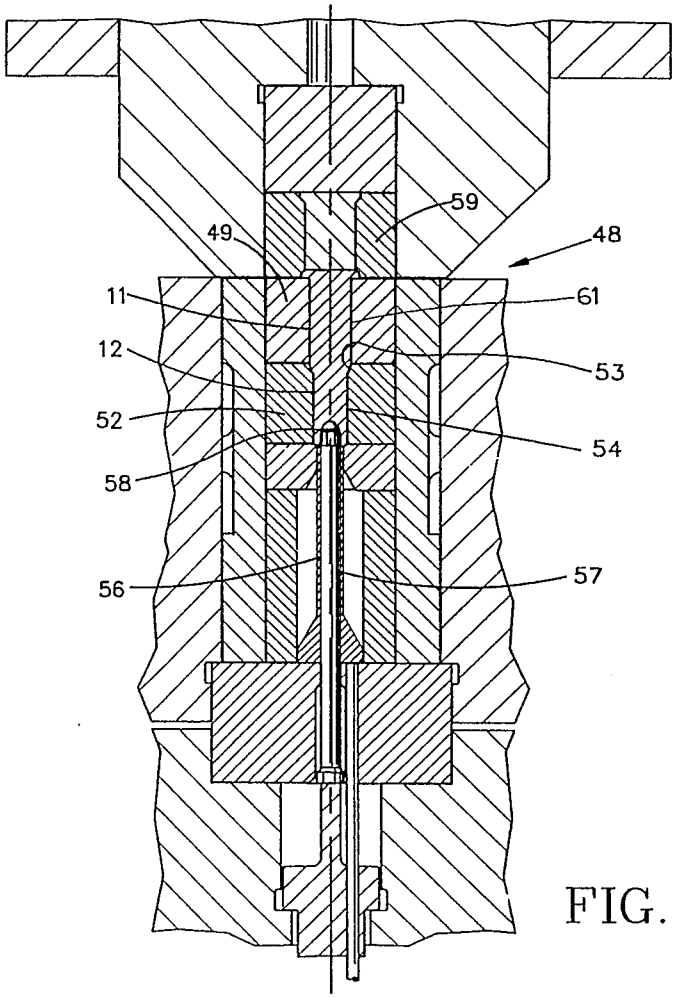
FIG. 9 is a cross section similar to FIG. 8 but illustrating the position of the tooling and the finished workpiece at the completion of the last operation.
Figure 8:
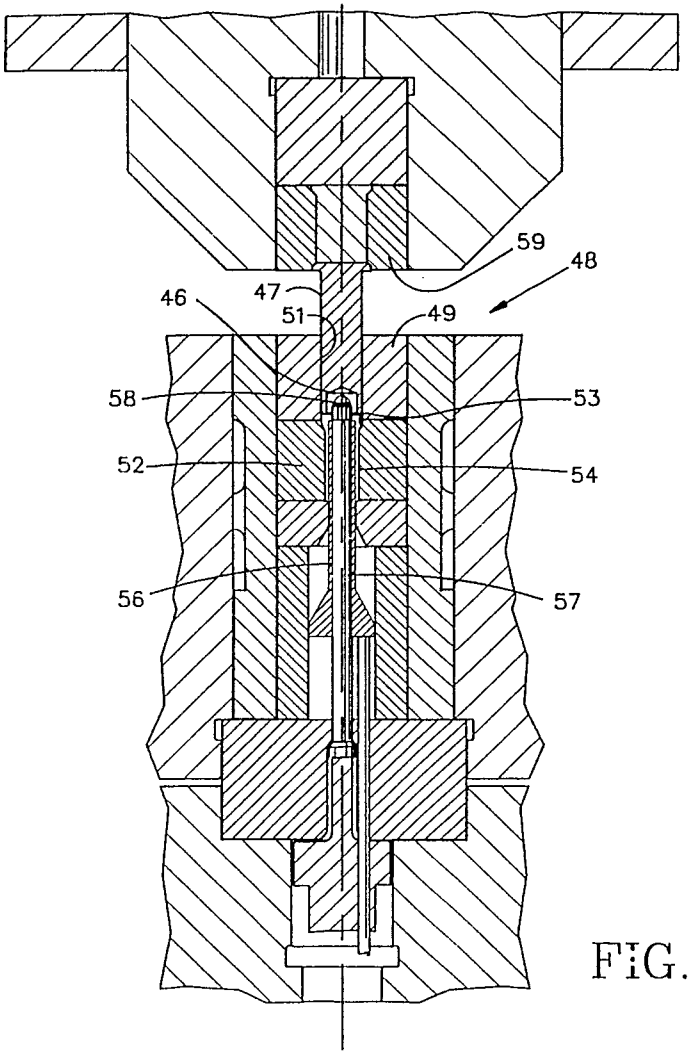
FIG. 8 is a longitudinal section of the tooling at a third work station illustrating the various tooling components in the position in which the finish tool is positioned within the preliminary socket but before the blank is extruded.

After the forming operation occurring in the second work station 35 is completed, the stripper sleeve 39 is advanced to eject the second intermediate blank 47 from the die 37 and the transfer operates to position the blank at a third work station 48, illustrated in FIGS. 8 and 9. Located at the third work station 48 is a set of dies including an outer, tubular die 49 having a cylindrical die cavity 51 therein sized to closely fit the periphery of the cylindrical portion of the second intermediate blank 47. Inwardly from the outer die 49 is an inner die 52 having a conical extrusion throat 53 from which a cylindrical die cavity 54 extends. The diameter of the die cavity 54 is approximately equal to the diameter of the extension 12 of the finished blank.

Extending along the die cavity 54 is a stripper sleeve 56 through which a finish tool 57 extends. The finish tool is formed with an end having the shape of the required wrenching socket 13, and in the illustrated embodiment is a hexagon in cross section. Both the stripper sleeve 56 and the finish tool 57 are slidable in the die cavities and, at the commencement of the working operation occurring at the third work station, the hexagonal end 58 is positioned forwardly within the dies and is located within the preliminary cylindrical socket 46 of the blank as the blank moves in along the outer die cavity 51.

Here again, tooling 59 is mounted on the slide assembly 19 and engages the head 10 of the second intermediate blank 47 as it moves toward its full forward position. The completion of the working operation, is illustrated in FIG. 9. Initially, the blank moves along the outer die cavity 51, with the hexagonal end 58 of the finish tool 57 positioned within the preliminary socket 46, until the inner end of the second intermediate blank 47 reaches the extrusion throat 53.

As the tooling 59 continues toward the die 49, the forward end of the blank is pressed through the extrusion throat 53 and is deformed radially inward against the hexagonal end 58 of the finish tool. The hexagonal end and the extrusion die are sized so that the material forming the end of the intermediate blank is pressed into tight mating engagement with the hexagonal end to form the finished hexagonal socket 13 of the finished fastener blank 61 illustrated in FIG. 4. Further, as the blank is carried forward, the blank material is extruded to reduce the diameter of the extension 12, completing the manufacture of the fastener. Subsequently, the threads are rolled onto the reduced diameter extension 12 to complete the fastener.

It is preferable to size the preliminary socket 46 so that the cross-sectional area of the material of the second intermediate blank 47 surrounding the preliminary socket 46 is slightly greater than the cross-sectional area of the material of the finished blank 61 surrounding the hexagonal wrenching socket 13, so that a limited amount of extrusion occurs around the hexagonal end. This ensures that intimate contact is established between the surface of the hexagonal wrenching socket and the hexagonal end 58 of the punch. Therefore, the depth of the socket 13 tends to exceed the depth of the cylindrical portion of the preliminary socket 46 a small amount.

Figure 4A:
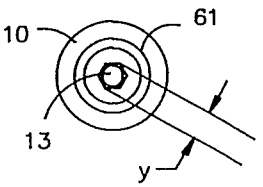
FIG. 4a is an end view of the blank illustrated in FIG. 4.
Figure 3A:
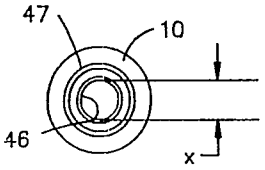
FIG. 3*a* is an end view of the blank illustrated in FIG. 3.

Further, it is preferable to size the preliminary punch so that the preliminary socket 46 has a diameter, indicated at X in FIG. 3*a*, which is at least as greater as the across-corners dimension Y, illustrated in FIG. 4*a*, of the hexagonal socket. With such a dimensional relationship, the hexagonal end 58 enters the preliminary socket 46 without requiring any deformation of the material of the blank. In fact, it is preferable to form the diameter of the preliminary socket 46 larger than the maximum lateral dimension of the wrenching socket 13, so that the end of the punch has the maximum strength possible consistent with the size requirements of the finished fastener.

In the particular illustrated embodiment the outside diameter of the second intermediate blank is about 0.223 inch, and the preliminary socket has a diameter of about 0.108 inch. Further, the preliminary socket has a depth of the cylindrical portion thereof of about 0.085 inch. After the extrusion operation, the reduced diameter extension 12 has a diameter of about 0.174 inch. Across the flats of the hexagonal socket, the finished socket 13 has a lateral dimension of about 0.079 inch and a depth of about 0.090 inch.

With the present method, very small hex sockets can be successfully produced in production by forging even in hard-to-form material such as titanium or high-strength steel without excessive wear of the tooling. For example, a finished tool having the dimensions mentioned above successfully functioned to produce over 90,000 titanium parts without encountering any measurable wear or damage. Further, because the preliminary socket was formed of a somewhat larger diameter cylindrical punch, the preliminary punch did not experience excessive wear, even when forming titanium.

In the processing of titanium fasteners as illustrated, the blank material was heated to about 1400° F. to increase its plasticity prior to being formed into the finished blank. However, satisfactory tool life can be obtained in materials which are more easily forged when the forging operations are conducted at room temperature.

Although the preferred embodiment of this invention has been shown and described, it should be understood that various modifications and rearrangements of the parts may be resorted to without departing from the scope of the invention as disclosed and claimed herein.

What is claimed is:

1. A forging machine for producing elongated articles having a non-circular socket extending along said article from one end thereof from an elongated blank having a uniform cross section, comprising a frame, a slide reciprocable on said frame, said machine providing at least two work stations, tooling supported by said frame and slide at each of said work stations, said tooling at one of said work stations including a die having a die cavity extending from an entrance end and sized to closely fit the exterior of one end of said blank, and a first punch within said die cavity having a cylindrical end extending toward and spaced back from said entrance end, said tooling at said one work station also including tool means operable to engage the other end of said blank and move said one end of said blank along said die cavity and over said punch to form a cylindrical socket in said one end without increasing the size of said one end, said tooling at the other of said work stations including a second die having a second die cavity extending from an entrance end to an extrusion throat spaced from said entrance end, and a second punch having a non-circular end sized to fit into said cylindrical socket without substantial interference, said extrusion throat and non-circular end of said second punch being relatively movable from a first portion in which said non-circular end projects through said extrusion throat toward said entrance end of said second die and a second position in which said non-circular end is on the side of said extrusion die remote from said entrance end of said second die, said tooling at said other work station also including a second tool means operable to apply an axial force to said other end of said blank causing said one end of said blank to engage said extrusion throat and pass therethrough while said non-circular end of said second punch is positioned in said cylindrical socket to laterally deform the material of said blank against said non-circular end forming said non-circular socket without applying substantial longitudinal forces to said second punch.

2. A machine as set forth in claim 1, in combination with a heater for preheating said blank.

3. A forging machine for producing elongated articles having a non-circular socket extending in along said article from one end thereof from an elongated blank having a uniform cross section, comprising a frame, a slide reciprocable on said frame, said machine providing at least two work stations, tooling supported by said frame and slide at each of said work stations, said tooling at one of said work stations including a cylindrical first punch and means for pressing said blank onto said first punch, operable to press into said blank from one end to form a cylindrical socket in said blank extending into said one end, said tooling at the other of said work stations including a second punch having a non-circular end sized to fit into said cylindrical socket without substantial interference and an extrusion throat about said non-circular end and sized to reduce the size of said blank around said cylindrical socket, said tooling at said other work station also including tool means operable to engage the other end of said blank and apply a force thereto to move said one end into and through said extrusion throat while said second punch non-circular end is in said cylindrical socket causing the material of said blank around said cylindrical socket to deform inwardly into engagement with said non-circular end of said second punch to form said non-circular socket without exerting substantial longitudinal forces on said second punch.

4. A forging machine as set forth in claim 3, wherein said non-circular end is hexagonal.

5. A forging machine as set forth in claim 4, wherein said extrusion throat operates to reduce the cross-sectional area of the blank around said cylindrical socket.

6. A forging machine as set forth in claim 5, wherein said machine provides a third work station having tooling supported on said frame and slide operable to form a head on the other end of said blank.

7. A forging machine as set forth in claim 5 in combination with a heater for preheating said blank.

8. A method of forming metal elongated articles having a non-circular socket extending into one end, comprising pressing a circular punch into one end of a blank to form a cylindrical socket in said one end thereof, positioning a noncircular punch in said cylindrical socket, and while said noncircular punch is so positioned pressing said one end of said blank through an extrusion throat by a force applied to the other end of said blank to displace the material of said blank around said cylindrical socket into engagement with said non-circular punch to form said cylindrical socket into a non-cylindrical socket without applying substantially longitudinal forces to said non-circular punch.

9. A method as set forth in claim 8, including applying lateral pressure to produce a cylindrical periphery around said non-circular socket during said pressing step.

10. A method as set forth in claim 8, including sizing said blank and said cylindrical socket so that the cross-sectional area of the material of said blank surrounding said cylindrical socket is larger than the cross-sectional area of the material of said blank surrounding said non-circular socket to ensure intimate engagement between said blank material and said non-circular punch.

11. A method as set forth in claim 8, including providing said blank with an initial diameter and during said pressing step extruding a portion of said blank at said one end to a cylindrical shape having a diameter less than said initial diameter of said blank.

12. A method as set forth in claim 11, including upsetting a head on the other blank.

13. A method as set forth in claim 12, including forming said article from a titanium blank.

14. A method as set forth in claim 13, including forming said non-circular socket with a hexagonal cross section having an across-the-flats dimension less than 0.1 inch, and preheating said blank to increase the plasticity thereof.

15. A method as set forth in claim 14, including preheating said blank to at least about 1200° F.

16. A method of forming titanium "HI-LOK" fasteners from a cylindrical blank comprising upsetting a head on one end of said blank, pressing the other end of said blank over a cylindrical tool to form a cylindrical socket therein, positioning a second tool having a hexagonal end in said cylindrical socket, and while said hexagonal end remains in said cylindrical socket applying a force to said one end of said blank for pressing said other end through an extrusion die and forming said other end into engagement with said hexagonal end to produce a hexagonal socket therein without applying substantial longitudinal forces to said second tool.

17. A method as set forth in claim 16, including preheating said blank to a temperature of about 1200° F. to 1400° F.

* * * * *

UNITED STATES PATENT AND TRADEMARK OFFICE

CERTIFICATE OF CORRECTION

PATENT NO. : 4,805,437

DATED : Feb. 21, 1989

INVENTOR(S) : Nicholas A. Heil, Jr., et al.

It is certified that error appears in the above-identified patent and that said Letters Patent is hereby corrected as shown below:

Under references cited, fifth reference, "1939" should be --1938--.

Col. 1, line 52 "highstrength" should be --high-strength--.

Col. 2, line 11 "ore" should be --or--.

Col. 2, lines 11 and 12 "dimensions" should be --dimension--.

Col. 4, line 12 "socket" (second occurrence) should be --second--.

Col. 5, line 12 "greater" should be --great--.

Col. 6, line 40 after "punch," should be inserted --said first punch--.

Signed and Sealed this

Twenty-ninth Day of August, 1989

*Attest:*

*Attesting Officer*

DONALD J. QUIGG

*Commissioner of Patents and Trademarks*